US006655184B2

(12) United States Patent
Meaney et al.

(10) Patent No.: US 6,655,184 B2
(45) Date of Patent: Dec. 2, 2003

(54) WARM/HOT CORRUGATION MACHINE AND METHOD FOR CORRUGATING LOW-DUCTILITY FOILS

(75) Inventors: John E. Meaney, Bonita, CA (US); Thomas J. Liebig, Chula Vista, CA (US); Raymond R. Listak, Chula Vista, CA (US); Robert B. Leholm, Santee, CA (US); Jeffrey K. Switzer, San Diego, CA (US); Peter H. Ellis, Poway, CA (US); Jack D. Beyer, Escondido, CA (US)

(73) Assignee: Rohr, Inc., Chula Vista, CA (US)

( * ) Notice: Subject to any disclaimer, the term of this patent is extended or adjusted under 35 U.S.C. 154(b) by 0 days.

(21) Appl. No.: 09/970,572

(22) Filed: Oct. 4, 2001

(65) Prior Publication Data

US 2003/0094030 A1 May 22, 2003

(51) Int. Cl.[7] ..... B21D 13/04

(52) U.S. Cl. ..... 72/196; 72/200; 72/342.8; 72/370.19; 72/379.6; 72/414

(58) Field of Search ..... 72/38, 191, 194, 72/196, 197, 200, 201, 202, 342.1, 342.4, 342.5, 342.6, 342.8, 342.94, 364, 370.19, 379.2, 379.6, 414, 419, 420; 428/593, 603, 604

(56) References Cited

U.S. PATENT DOCUMENTS

| | | | | | |
|---|---|---|---|---|---|
| 2,481,049 | A | * | 9/1949 | Stann et al. | 72/342.1 |
| 2,901,932 | A | * | 9/1959 | Erdelyi | 72/38 |
| 3,017,971 | A | | 1/1962 | Christman | |
| 3,616,025 | A | | 10/1971 | Fairbanks | |
| 3,834,199 | A | * | 9/1974 | Rouyer et al. | 72/38 |
| 4,179,912 | A | * | 12/1979 | Culina et al. | 72/196 |
| 4,381,212 | A | * | 4/1983 | Roberts | 156/473 |
| 4,753,096 | A | * | 6/1988 | Wallis | 72/196 |
| 5,616,204 | A | * | 4/1997 | Duffy et al. | 156/156 |

FOREIGN PATENT DOCUMENTS

| | | | | |
|---|---|---|---|---|
| DE | 41 30 673 A 1 | | 3/1993 | |
| GB | 2 109 293 A | | 6/1983 | |
| JP | 59-212126 | * | 12/1984 | 72/38 |

OTHER PUBLICATIONS

Pending U.S. patent application Ser. No. 09/970,571.

* cited by examiner

*Primary Examiner*—Ed Tolan
(74) *Attorney, Agent, or Firm*—Goodwin Procter LLP

(57) ABSTRACT

A machine and method for corrugating a metal foil strip utilizes an enclosure defining a chamber and a controllable heat source for heating the chamber. The chamber may optionally include at least one gas that is also heated by the heat source. At least one tool set received in the chamber forms corrugations in the metal foil strip. Foil entry feeder elements supply and guide the metal foil strip from outside the chamber into the chamber and to the tool set. A drive for the tool set is mounted outside the chamber and coupled to the tool set to actuate the tool set. Foil exit delivery elements guide the strip from the tool set and out of the chamber. Where required to prevent oxidation of the foil strip, a source supplying an inert gas to the chamber at a controlled rate is used.

52 Claims, 7 Drawing Sheets

FIG. 1

WARM/HOT CORRUGATION MACHINE AND METHOD FOR CORRUGATING LOW-DUCTILITY FOILS

BACKGROUND OF THE INVENTION

1. Field of the Invention

The present invention relates generally to the field of working metal foils and, more particularly, to corrugating metal foils that exhibit low room temperature ductility, such as gamma-titanium aluminide (γ-TiAl) foils.

2. Background Information

Because of the light weight and desirable mechanical properties at elevated temperatures of γ-TiAl, significant research has been conducted regarding fabrication and producibility of honeycomb sandwich panels for use in high temperature aerospace applications. In order to produce γ-TiAl core sections for use in honeycomb panel construction, forming/corrugating thin foil strip is required. A significant problem with γ-TiAl is that it exhibits low room temperature ductility, which presents difficulties in forming it at room temperature. Moreover, γ-TiAl becomes more susceptible to surface oxidation when heated to high temperatures (>1400° F.). In addition, when hot forming thin foils of any metal, rapid heat loss in the foil may occur during the forming process when the foil comes into contact with the machine forming tool faying surfaces (e.g., forming gears). This situation exacerbates the difficulties of consistently producing an end product that has the desired shape and is free of defects (e.g., cracks and altered surface grain structure). Furthermore, the environment around the forming tool area also may add to the foil forming/corrugation difficulties in regards to surface interstitial diffusion.

For the foregoing and other reasons, there is, accordingly, a need for a machine for, and a method of, corrugating metal foils that exhibit low room temperature ductility. In particular, there is a need for a machine, and a method, for corrugating such metal foils under conditions that ensure reliable production of a corrugated foil that is free of defects and has a desired end geometry.

SUMMARY OF THE INVENTION

The foregoing need is fulfilled, in accordance with the present invention, by a machine for corrugating metal foil strip lengths that includes an enclosure defining a chamber and a controllable heat source for heating the chamber. A gas or combination of gases may or may not be introduced into the chamber. At least one corrugation-forming tool set located in the chamber forms corrugations into the metal foil strip. Foil entrance feeder elements supply and guide the metal foil strip from outside the chamber into the chamber and to the tool set. A drive for the tool set is mounted outside the chamber and coupled to the tool set to actuate the tool set. Foil exit delivery elements guide the strip from the tool set and out of the chamber.

The heat source for the chamber maintains—by using convection or radiation heating, or a combination thereof—a quasi isothermal temperature of the tool set and also heats the foil strip as it is guided to the tool set, such that when it is worked by the tool set it has sufficient ductility to be formed without cracking. Moreover, the heated tool set precludes any heat loss from the foil strip at the time of working that might alter its mechanical properties. The drives for the tool set are located outside the chamber where they are protected from the heat.

In some cases, the foil strip can be corrugated without heating the chamber to a temperature sufficiently high to oxidize the tool set, the foil strip, or both. When the machine and method involve temperatures in the chamber high enough to oxidize the tool set or foil strip, or both, a source supplying an inert gas to the chamber at a controlled gas flow rate may be used.

As explained more fully below, there are inherently significant gradients of heat along the length of the foil strip that resides at any given time between a supply roll of the foil stock and the delivery point of the corrugated foil strip after it leaves the heated chamber. On the incoming side of the chamber immediately outside of an opening in a wall of the chamber through which the strip enters the chamber, the cool incoming part of the strip is not heated enough to be subject to oxidation. While in the chamber, the inert gas prevents oxidation of the strip. The portion of the strip between the tool set and an exit opening from the chamber is progressively cooler near the exit opening, due to both heat loss by conduction along the strip to the cooler part of the strip outside of the chamber and to the cooler gases that are present near the walls of the chamber. Accordingly, when the strip leaves the chamber, it is no longer hot enough to be oxidized by the ambient air.

In preferred embodiments, the enclosure is double-walled and liquid-cooled so as to provide a large temperature gradient through the gas environment near the enclosure chamber walls (as well as through the chamber double walls). Those temperature gradients allow portions of the strip outside the chamber to remain at sufficiently low temperatures to avoid oxidation and to keep the outside of the enclosure at a relatively low temperature.

The enclosure may include partition walls forming a medial chamber and end sub-chambers on opposite ends of the medial sub-chamber and openings between the medial chamber and each sub-chamber through which the foil strip passes between the sub-chambers. This geometric arrangement of the entire chamber allows a foil strip to enter the medial sub-chamber from one end sub-chamber and to pass into the other end sub-chamber from the medial sub-chamber. The partition walls may be cooled with internal "water jackets." The tool set and the heating elements for heating the gas are located in the medial sub-chamber. The inert gas is supplied to the medial chamber. The partition walls of the medial chamber establish a temperature gradient between the inside of the medial chamber and the insides of the end sub-chambers. The inert gas passes from the medial sub-chamber through the openings in the partition walls into the end sub-chambers. The foil feeder elements and foil exit delivery elements guide the strip through the sub-chambers and/or through the medial chamber.

The foil feeder elements may include guide members within the chamber that form a serpentine delivery path for the strip so as to permit the strip to be heated before it reaches the tool set. Other suitable feeder elements include a guide chute supporting the strip along a path from the supply opening in a wall of the enclosure to the tool set. The guide chute provides a path for heat conduction along its length, so that the chute is relatively cool adjacent the wall of the enclosure and relatively hot near the tool set. The chute can be designed to establish a desired temperature gradient along its length. The foil strip, being in contact with the chute, exchanges heat with the chute and possesses a temperature—and temperature gradient—close to that of the chute. Likewise, and with similar effect, the delivery elements may include—or consist of—a guide chute supporting the strip along a path from the tool set to the exit opening in a wall of the enclosure.

The tooling in the enclosure may include a pre-form tool set that partially forms corrugations and a final tool set that fully forms the corrugations. Forming corrugations in two (or more) stages will affect the amount of foil springback. Given a similar final foil corrugation geometry, the strain rate during forming in each stage of a two-stage forming process will be less (for any given machine throughput) than if only a single-stage forming process is employed.

Various tool sets may be used in a machine according to the invention, such as:

1) A driven form gear having forming teeth and an idler form gear having forming teeth meshing with the forming teeth of the driven form gear and driven by the driven form gear.
2) A driven form gear having forming teeth, an idler pre-form gear having forming teeth meshing with the forming teeth of the driven form gear at a first location along the perimeter of the driven form gear and driven by the driven form gear, and an idler final form gear having forming teeth meshing with the forming teeth of the driven form gear at a second location along the perimeter of the driven form gear spaced apart from the first location and driven by the driven form gear.
3) A driven form gear having forming teeth, an idler form gear having forming teeth meshing with the forming teeth of the driven form gear, and a gear train coupling the driven form gear and the idler form gear so that both the driven and idler form gears are driven in rotation;
4) A pre-form tool set and a separate final tool set, each having a driven form gear having forming teeth, an idler form gear having forming teeth meshing with the forming teeth of the driven form gear, and a gear train coupling the driven form gear and the idler form gear so that both the driven and idler form gears are driven in rotation; the driven form gear of one of the tool sets is driven by the driven form gear of the other tool set.
5) A driven form gear having teeth defining cavities and a punch having a tooth substantially complementary in shape to the shape of the cavities. With a form gear/punch tool set, the drive includes a rotary drive that rotates the driven form gear and a reciprocating linear actuator driving the punch radially of the form gear. Preferably, the rotary drive rotates the form gear intermittently with a dwell period during which the punch forms a corrugation in the strip by deforming the strip into a cavity of the form gear. The punch may include a holder foot that engages an outgoing loop of a corrugation of the strip against the tip of the tooth of the form gear on the outgoing side of the cavity on each forming stroke of the tooth of the punch.
6) A pre-form tool set and a final tool set, both tool sets sharing a driven form gear having teeth defining cavities. The pre-form tool set includes a pre-form punch having a tooth partially complementary in shape to the shape of the cavities. The final pre-form tool set includes a final punch having a tooth substantially complementary in shape to the shape of the cavities. The final punch is spaced apart circumferentially of the form gear from the pre-form punch. The drive includes a rotary drive, preferably driven intermittently with a dwell period during actuation of the punches, rotating the driven form gear and a reciprocating linear actuator driving each punch radially of the form gear. Each punch may have a holder foot that engages an outgoing loop of a corrugation of the strip against the tip of the tooth of the form gear on the outgoing side of the cavity on each forming stroke of the tooth of the punch.

The foregoing description has outlined rather broadly some features and advantages of the present invention. The detailed description of embodiments of the invention that follows will enable the present invention to be better understood and the present contribution to the art to be more fully appreciated. Those skilled in the art will recognize that the embodiments may be readily utilized as a basis for modifying or designing other structures and methods for carrying out the purposes of the present invention. All such structures and methods are intended to be included within the spirit and scope of the invention as set forth in the appended claims.

DETAILED DESCRIPTION OF THE INVENTION

Figure 1:
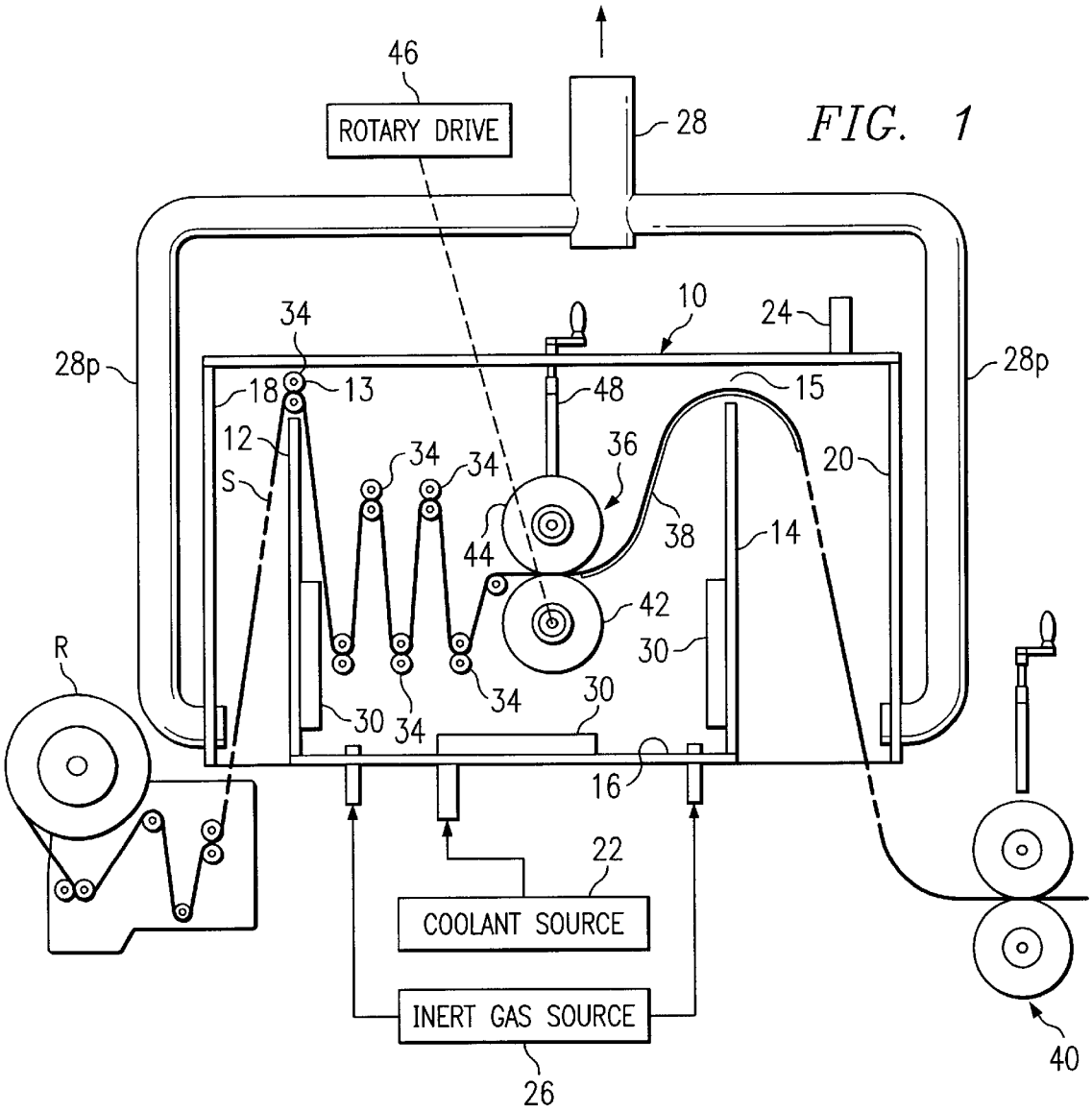
FIG. 1 is a generally schematic front elevational view of a first embodiment.
Figure 2:
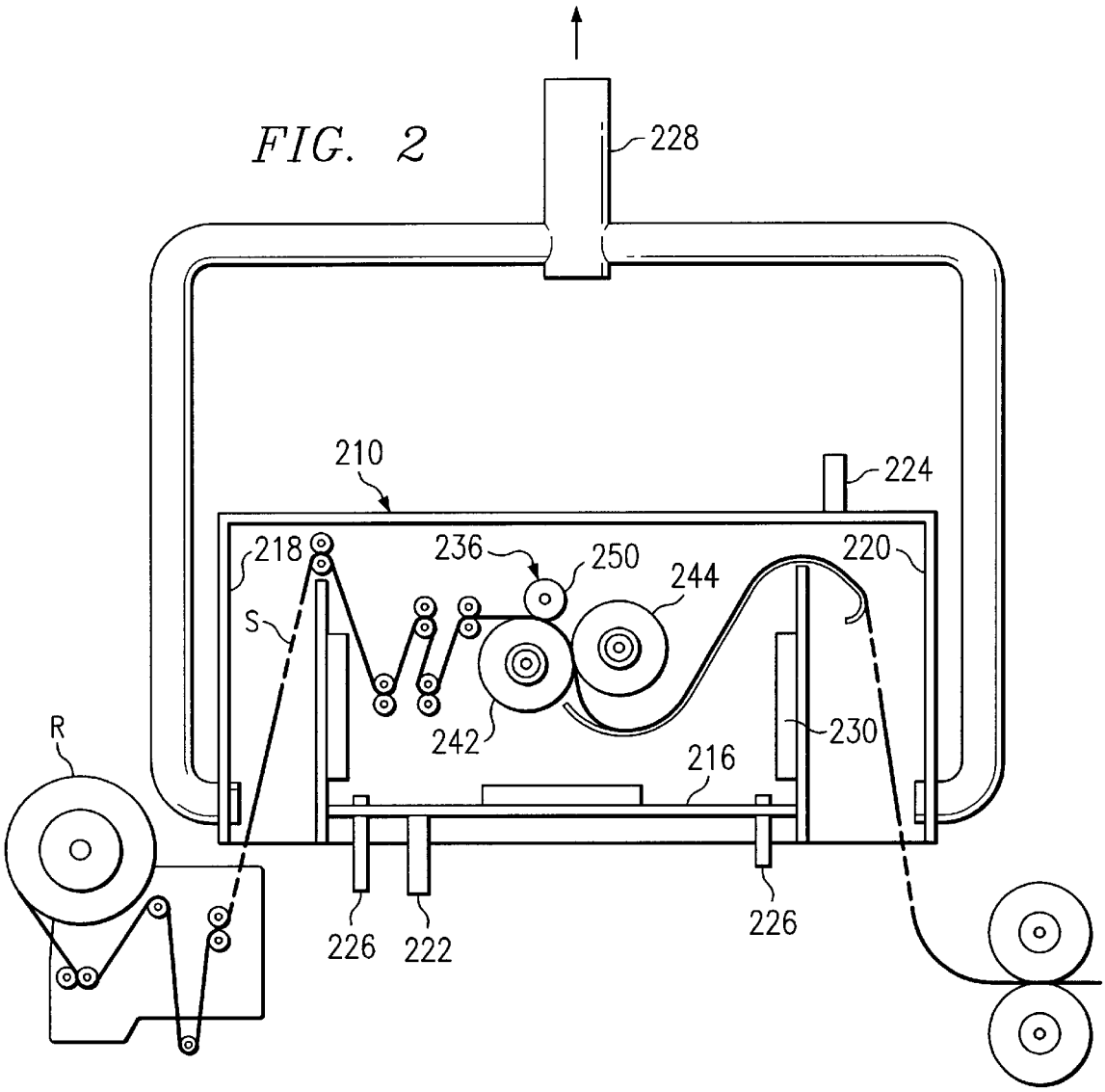
FIG. 2 is a generally schematic front elevational view of a second embodiment.
Figure 3:
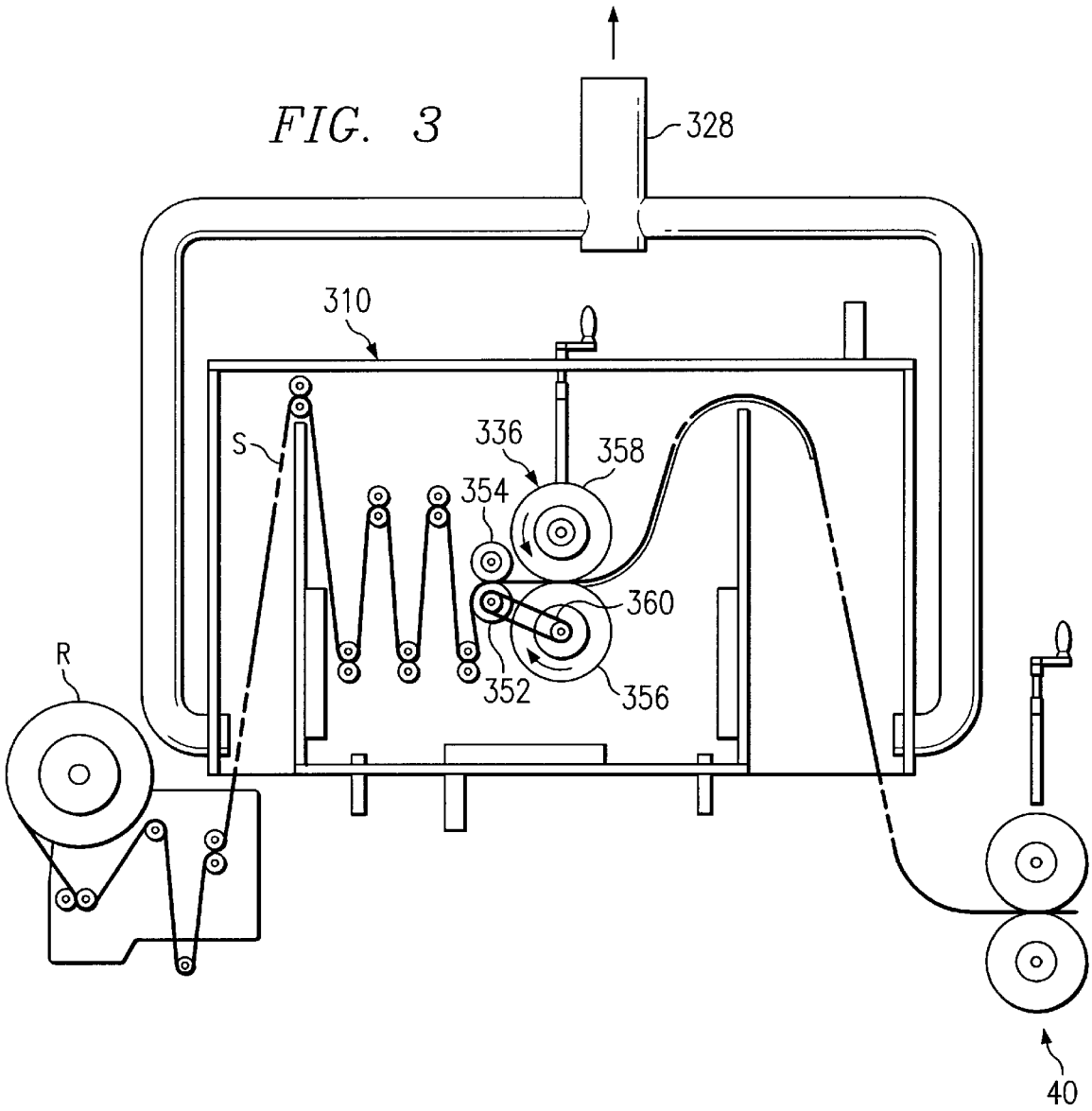
FIG. 3 is a generally schematic front elevational view of a third embodiment.

Referring to FIG. 1, the machine shown therein has a double-walled enclosure 10, which is subdivided by partition walls 12 and 14 to provide a medial sub-chamber 16 and end sub-chambers 18 and 20. The inner wall of the enclosure 10 is insulated. A coolant, which may be water, is continuously circulated through the jacket between the inner and outer walls of the enclosure 10 from a coolant source 22 to a coolant outlet 24. In practice, the coolant is circulated separately through each double-wall panel (top, bottom, ends and rear) that forms the enclosure and through a hinged access door on the front of the enclosure.

When needed to prevent oxidation of the tool set or the foil strip, an inert gas, such as argon, is supplied from an inert gas source 26 to the medial sub-chamber at a controlled gas flow rate and is exhausted through an exhaust outlet 28, which is connected by pipes 28*p* to the end sub-chambers. The inert gas fills the enclosure 10 and is replenished continuously so as to purge substantially all oxygen from the sub-chambers, including any oxygen that is released from the walls of the enclosure and parts of the machine within the chamber. The inert gas in the chamber is heated by heating elements 30 located in the medial sub-chamber. The temperature of the inert gas in the chamber is, of course, suitably controlled.

The foil strip S that is to be corrugated in the machine is supplied from a roll R, is admitted into the end sub-chamber 18 through a slot in the bottom wall of the enclosure, and is guided along a tortuous path formed by guides 34 to a tool set 36 (described below) that forms corrugations in the foil strip. The corrugated strip is guided away from the tool set along a chute 38 and after passing through the end sub-chamber 20 exits the enclosure through a slot. The strip passes from the end sub-chamber 18 into the medial sub-chamber 16 through an opening 13 at the upper edge of the wall 12 and passes from the medial sub-chamber 16 into the end sub-chamber 20 through an opening 15 at the upper edge of the wall 14. The openings allow the inert gas that enters the medial sub-chamber 16 from the source 26 to flow from the medial sub-chamber 16 into the end sub-chambers 18 and 20 and thence to the exhaust pipes 28*p*. Because the inert gas in the chamber formed by the enclosure 10 is at a pressure above atmospheric, gas leakage from the chamber to the outside of the enclosure through the slots through which the foil strip enters and leaves the chamber is acceptable.

There are relatively large temperature gradients within the medial and end sub-chambers and between the medial sub-chamber and the end sub-chambers. Therefore, the foil strip S, which is thin and thus transfers heat readily in the thickness direction, is subject to gradients of temperatures as it passes into, through and out of the sub-chambers in the enclosure 10. The coolest regions of the chamber are the lowest portions of the end sub-chambers 18 and 20. As the inert gas flows from the openings 13 and 15, it gives up heat to the top and end walls of the enclosure. Heat is also given up to the relatively cool incoming foil strip S. The highest temperatures in the chamber formed by the enclosure 10 are in the center region of the medial sub-chamber 16, which is remote from the cooled walls of the enclosure and in proximity to the heating elements 30. The guides 34 and the tool set 36 within the medial sub-chamber 16, which contact the foil strip, are kept heated by the inert gas, so heat exchange between those components and the foil strip is minimal. The guides 34 may be of a ceramic or other material with a low heat conductivity. The tortuous path for the foil strip S enables the strip to reside in the hot medial sub-chamber 16 for a sufficient time to be highly heated before it is worked by the tool set 36. The inert gas prevents the foil strip and the tool set from being oxidized at the high temperature ranges to which the foil will in most uses of the machine be heated for forming/corrugation. In some cases, the machine can be used without activating the inert gas supply.

After being corrugated by the tool set 36, the strip S is guided along the chute 38 through the opening 15, passes down through the end sub-chamber 20 and out of the chamber of the enclosure 10 through a slot in the bottom wall. The chute 38 is designed to receive heat from the now-corrugated strip by conduction—the chute 38 is of a material that conducts heat and is fastened to the relatively cool rear wall of the enclosure 10 so that it is at a significantly lower temperature than that of the gas in the medial sub-chamber 16. The strip S continues to cool as it passes through the end sub-chamber 20. By the time the strip leaves the enclosure 10, it has cooled sufficiently to be able to enter the air without a risk of oxidizing.

The then-corrugated strip is conducted through and between sizing rolls 40, which are smooth circumferential tool rolls that perform an additional adjustment to the as-corrugated foil formed shape (specifically, the pitch), to accommodate any changes due to non-uniform springback.

The tool set 36 of the embodiment shown in FIG. 1 consists of a driven form gear 42 and an idler form gear 44. The shaft of the driven form gear 42 is supported by bearings located outside the enclosure and is driven in rotation by a rotary drive 46 that is also located outside of the enclosure. Each form gear has teeth that mesh with the teeth of the other form gear, the teeth and cavities between the teeth of the form gear pair being shaped to form corrugations in the strip S of the desired shape. Corrugating very thin foils, which may be from about 0.002" to about 0.006" thick, requires setting the form gears very precisely. To that end, the idler form roll 44 is mounted in bearings outside the enclosure that are carried by an adjustable mount, which is indicated schematically in FIG. 1 by the crank 48.

The second to sixth embodiments of machines according to the present invention, which are shown in FIGS. 2 to 7) are similar in many respects to the first embodiment. Accordingly, much of the description set forth above of the first embodiment is applicable to many aspects of the second to sixth embodiments and is not repeated in the descriptions below of the second to sixth embodiments. Also, the reference numerals applied to the elements of the second to the sixth embodiments in the drawings have the same last two digits as the corresponding elements of the first embodiment. The first digits of the reference numerals applied to the elements of the second to the sixth embodiments correspond to the number of the embodiment. For example, the first digit of the reference numerals applied to the second embodiment is 2, the first digit of the reference numerals applied to the third embodiment is 3, etc.

As shown in FIG. 1, the tool set 36 of the first embodiment—a single pair of meshing form gears 42 and 44 fully forms each corrugation in the strip in a single stage of working, in which each corrugation is formed by progressive elongation and bending of a segment of the strip as a tooth of one form gear pushes the segment into a cavity of the other form gear. In the second embodiment (FIG. 2), the tool set 236 consists of a driven form gear 242, an idler form gear 244, and an idler pre-form gear 250. The pre-form gear 250 has teeth that seriatim push segments of the strip S partway into the cavities of the driven form gear 242, thus partially forming the corrugations. The teeth of the idler form gear 244 complete the partially formed corrugations by pushing them seriatim more deeply into the cavities of the drive form gear 242. The pre-form gear 250 forms a partial corrugation by pulling an incoming segment of the strip into the cavity with little or no axial stretching. Since the strip arrives at the idler form gear 244 with partially formed corrugations tucked into the cavities of the driven form gear 242, the pushing of each partially formed corrugation more deeply into a cavity of the driven form gear 242 stretches the corrugation lengthwise of the strip.

In the third embodiment (FIG. 3), the tool set 336 includes a pre-form gear pair 352 and 354, which partially form corrugations in the strip S, and a final form gear pair 356 and 358, which complete the formation of the corrugations. One form gear 356 of the final form gear pair is driven by a rotary drive (not shown). The driven form gear 356 drives the pre-form gear 352 through a belt 360 and drives the final form gear 358. The pre-form gear 352 drives the pre-form gear 354, which is an idler.

Figure 4:
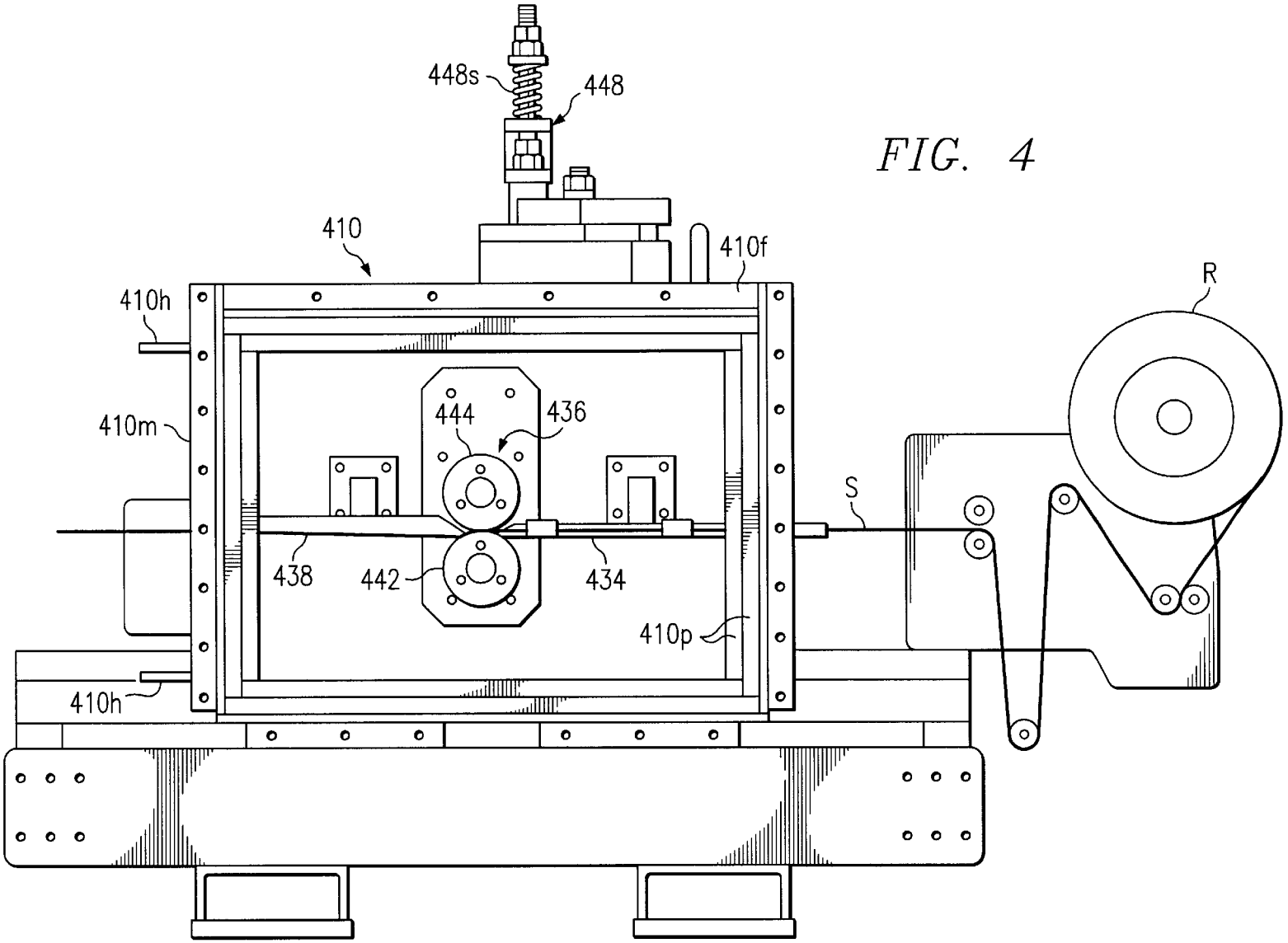
FIG. 4 is a generally schematic front elevational view of a fourth embodiment.

FIG. 4 shows additional elements of the fourth embodiment and contains a more detailed schematic depiction. The enclosure 410 has a double-walled, liquid-cooled main casing 410*m* with an opening at the front that is framed by a flange 410*f*. A double wall front cover (not shown) is coupled by a pair of hinges, one leaf 410*h* of each of which is shown, to the main casing 410*m*. The chamber casing is lined with at least one layer (shown in FIG. 4 as a double layer) of ceramic insulator panels 410*p*, the front edges of which are stepped so that they will mate with insulator panels having stepped edges on the front panel. Alternatively, more than two layers, say three layers, of ceramic insulator may be used in other embodiments of this invention. The front panel is normally bolted to the main casing by a mating flange on the front cover but can be opened for maintenance or replacement (e.g., to change the forming tools) of components within the enclosure by removing the bolts and swinging the cover open on the hinges. The enclosure 410 is not subdivided into sub-chambers, and there is no dedicated gas exhaust system (compare FIG. 4 with FIG. 1). In FIG. 4, the gas escapes through predetermined openings (e.g. gaps around the entry and exit foil feeders) through the chamber. The foil strip S is conducted through the enclosure along a horizontal, straight path, entering through a slot in the right (in the drawing) side wall and exiting through a slot in the left side wall. A guide 434 on the incoming side of the tool set 436 supports the strip and is configured to afford rapid heat transfer to the strip so that it arrives at the tool set at a high temperature for working. On the other hand, the guide 434 does not "feed" heat from within the chamber back to the part of the strip that is still outside the enclosure (and in the air) to an extent that the part that has not entered the enclosure might be oxidized. The outgoing part of the then corrugated strip S is supported along its exit path from the tool set by a guide 438, which is designed to cool the strip so that it leaves the enclosure at a temperature below that at which it is subject to oxidation. The guide 438 is also designed to prevent "pulling" heat away from the part of the strip that—at any point in time—is being corrugated by the tool set.

The tool set 436 consists of a driven form gear 442 and an idler form gear 444, the same type of tool set as in the first embodiment (FIG. 1). FIG. 4 shows the upper part of an adjustable support tower 448 for the idler form gear. One can observe an adjustable compression spring 448*s*, which biases the idler form gear 444 into engagement with the driven form gear 442 such as to form the corrugations under a predetermined "nip pressure" between the form gears. The spring 448*s* allows the gears to disengage in the event of over pressure of the gear tool set or a malfunction that causes a build up of strip in the tool set.

The fourth embodiment does not have an exhaust system as such for conducting inert gas from the chamber within the enclosure 410. Instead, the slots through which the foil strip enters and leaves the chamber (as well as other openings in the enclosure walls) are sized to allow leakage of the inert gas from the chamber at a suitable rate to ensure that the inert gas supplied to the chamber flows through the chamber and sweeps out oxygen.

The tool set 536 of the fifth embodiment (FIG. 5) consists of a rotating form gear 542 and a reciprocating punch 544. The form gear 542 is driven in rotation by a drive (not shown) intermittently to move each cavity seriatim into a position immediately below the punch 544 and then dwell while the punch 544 makes a cycle of a down movement and an up movement. The punch has a single forming tooth 544*t* (FIG. 6) that moves into the then-waiting cavity 542*c* of the form gear. The punch also has a spring-biased holding foot 544*f* located abreast of the forming tooth. On each down-stroke of the punch, which is actuated by a linear drive 536*d*, the holding foot 544*f* engages the segment of the foil strip that overlies the tooth of the forming gear immediately on the outgoing side of the cavity 542*c* into which the forming tooth is about to move on its down-stroke. The engagement occurs before the forming tooth engages the foil to begin forming the next corrugation, so that the outgoing corrugation of the foil strip is engaged and clamped by the holding foot against the tip of the outgoing tooth flanking the segment of the foil strip that will form the next corrugation to be formed before it is formed by a down-stroke of the punch. The clamping of the immediately outgoing corrugation while the next corrugation is formed ensures that the shape of each outgoing corrugation is retained rather than possibly being pulled partly back as the immediately following corrugation is formed. Each corrugation is formed of material from the incoming part of the foil strip, which is pulled into the cavity on the down-stroke of the punch. The rotary drive of the form gear and the linear actuator of the punch are computer/servo-controlled so as to time the rotations and dwell periods of the form gear and the dwell periods and strokes of the punch very precisely. Even though each corrugation in the foil strip is formed individually with an overall operating cycle that includes dwell periods for both the form gear and the punch, a well-designed machine according to FIG. 5 can be run at a speed that will produce up to several corrugations per second.

The sixth embodiment (FIG. 7), has a tool set 636 consisting of a form gear 642 that is rotated intermittently with a dwell period between each increment of rotation in which it remains stationary while a pre-form punch 644P partially forms a corrugation in one cavity and a final form punch 644F located circumferentially spaced apart from the pre-form punch in the direction of rotation of the form gear completes the formation of a partially formed corrugation previously started by the preform punch. The two punches 644P and 644F are identical except for the shapes of the forming tooth on each punch. Furthermore, punch 644F is identical to punch 544 of FIGS. 5 and 6, and punch 644P is identical to punch 544 except for the shape of the forming tooth on each punch. The machine is timed, of course, so that the cycles of the punches coincide and both punches dwell while the form gear rotates a distance equal to the pitch distance of the forming cavities.

Figure 5:
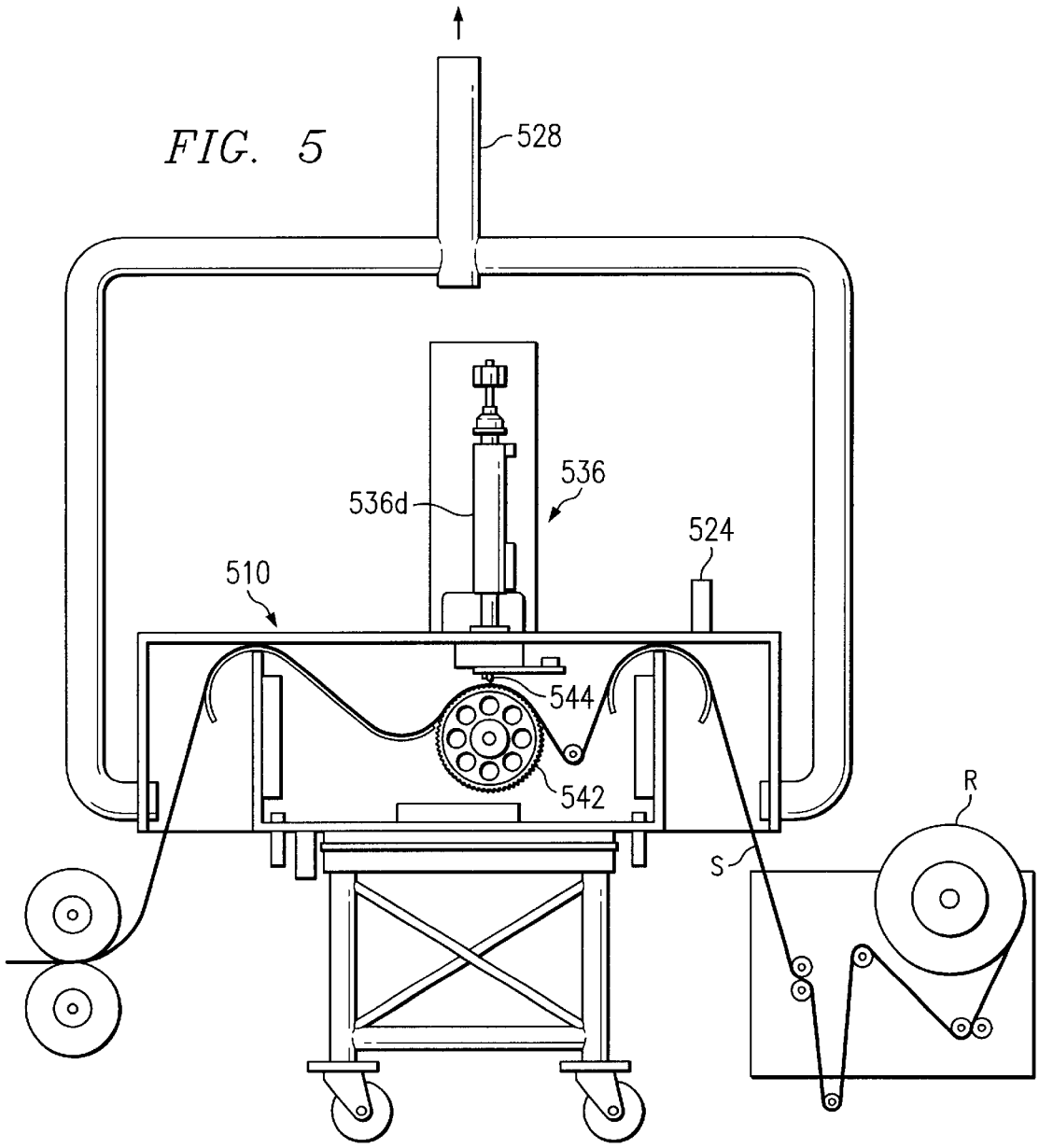
FIG. 5 is a generally schematic front elevational view of a fifth embodiment.
Figure 6:
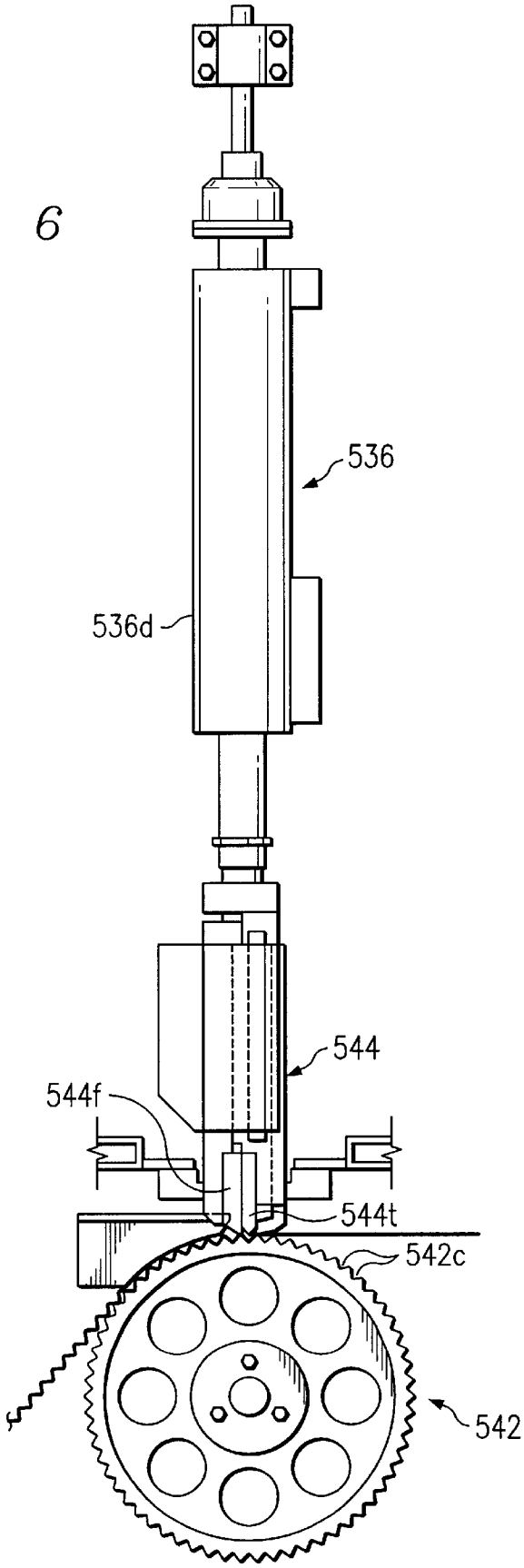
FIG. 6 is a generally schematic detail front elevational view of the punch and gear form tools of the fifth embodiment.
Figure 7:
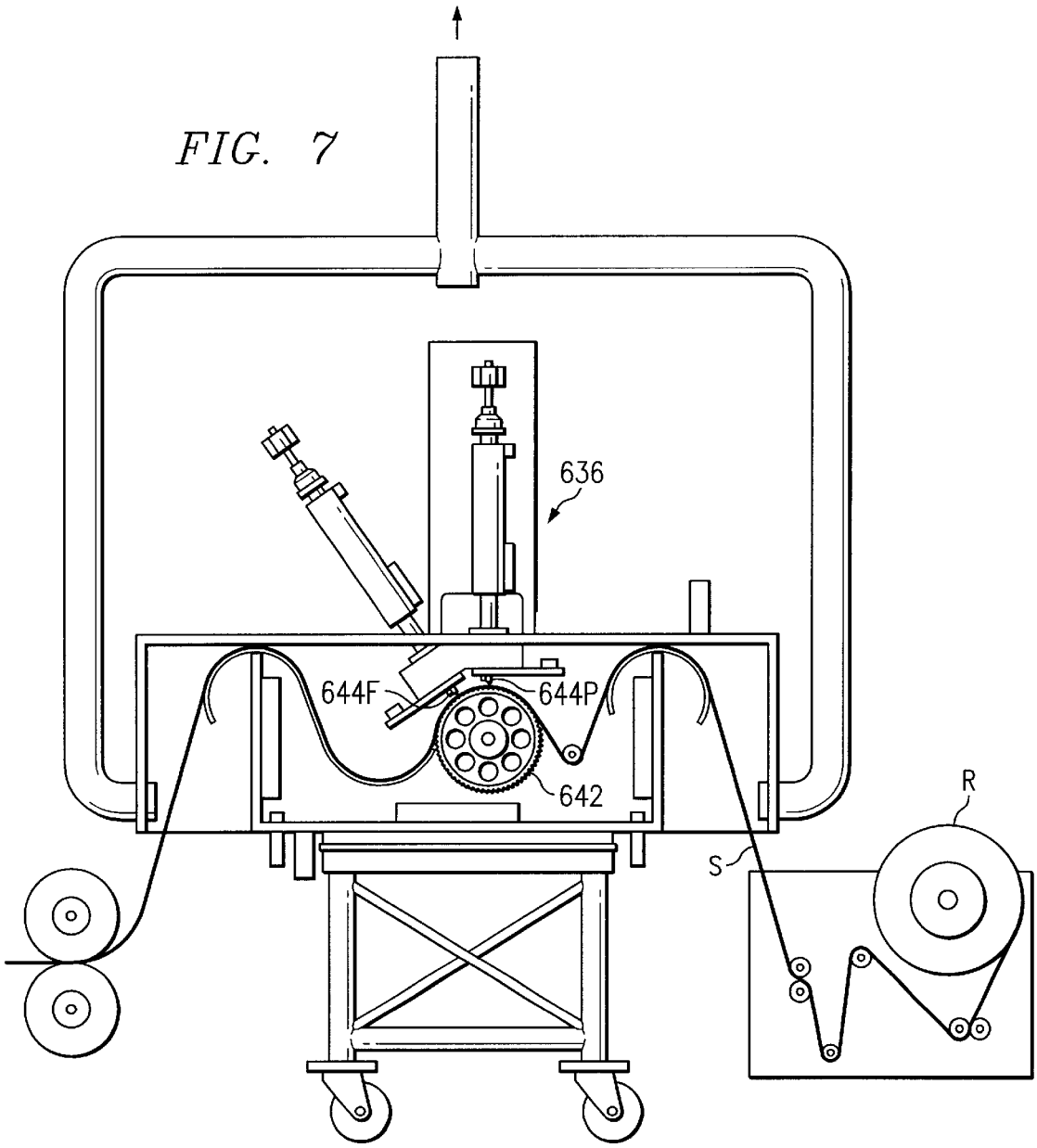
FIG. 7 is a generally schematic front elevational view of a sixth embodiment.

The tool sets of the embodiments shown in FIGS. 5 to 7 are described and shown in U.S. patent application Ser. No. 09/970,571 filed concurrently herewith, which is incorporated by reference herein for all purposes.

What is claimed is:

1. A machine for corrugating a metal foil strip, comprising (a) an enclosure defining a chamber wherein the enclosure is double-walled and liquid-cooled;

(b) a controllable heat source for heating the chamber;

(c) at least one tool set received in the chamber and adapted to form corrugations in the metal foil strip;

(d) feeder elements supplying and guiding the metal foil strip from outside the chamber into the chamber and to the tools;

(e) a drive for the at least one tool set mounted outside the chamber and coupled to the tool set to actuate the tool set; and (f) delivery elements guiding the strip from the tools and out of the chamber.

2. The machine according to claim 1, wherein at least one gas is introduced into the chamber and heated by the heat source.

3. The machine according to claim 1, and further comprising a source supplying an inert gas to the chamber at a controlled gas flow rate.

4. The machine according to claim 1, wherein the enclosure includes partition walls forming a medial sub-chamber and two end sub-chambers on opposite ends of the medial sub-chamber, a passage is provided between the medial chamber and each sub-chamber, the feeder elements and delivery elements guide the strip through the sub-chambers and passages, the at least one tool set is received in the medial sub-chamber, and the inert gas is supplied to the medial sub-chamber.

5. The machine according to claim 1, wherein the feeder elements include guide members within the chamber forming a serpentine delivery path for the strip so as to permit the strip to be heated before it reaches the at least one tool set.

6. The machine according to claim 4, wherein the feeder elements include guide members within the medial sub-chamber forming a serpentine delivery path for the strip so as to permit the strip to be heated within the medial sub-chamber before it reaches the at least one tool set.

7. The machine according to claim 1, wherein the feeder elements include a guide chute supporting the strip along a path from an opening in a wall of the enclosure to the at least one tool set.

8. The machine according to claim 1, wherein the delivery elements include a guide chute supporting the strip along a path from the at least one tool set to an opening in a wall of the enclosure.

9. The machine according to claim 1, wherein there is a pre-form tool set that partially forms corrugations and a final tool set that fully forms the corrugations.

10. The machine according to claim 1, wherein there is a tool set that includes a driven form gear having forming teeth and an idler form gear having forming teeth meshing with the forming teeth of the driven form gear and driven by the driven form gear.

11. The machine according to claim 1, wherein there is a tool set that includes a driven form gear having forming teeth, an idler pre-form gear having forming teeth meshing with the forming teeth of the driven form gear at a first location along the perimeter of the driven form gear and driven by the driven form gear, and an idler final form gear having forming teeth meshing with the forming teeth of the driven form gear at a second location along the perimeter of the driven form gear spaced apart from the first location and driven by the driven form gear.

12. The machine according to claim 1, wherein there is a tool set that includes a driven form gear having forming teeth, an idler form gear having forming teeth meshing with the forming teeth of the driven form gear, and a gear train coupling the driven form gear and the idler form gear so that both the driven and idler form gears are driven in rotation.

13. The machine according to claim 1, wherein there is a pre-form tool set and a final tool set and each tool set includes a driven form gear having forming teeth, an idler form gear having forming teeth meshing with the forming teeth of the driven form gear, and a gear train coupling the driven form gear and the idler form gear so that both the driven and idler form gears are driven in rotation.

14. The machine according to claim 13, wherein the driven form gear of one of the tool sets is driven by the driven form gear of the other tool set.

15. The machine according to claim 1, wherein there is a tool set that has a driven form gear having teeth defining cavities and a punch having a tooth substantially complementary in shape to the shape of the cavities, and the drive includes a rotary drive rotating the driven form gear and a reciprocating linear actuator driving the punch radially of the form gear.

16. The machine according to claim 15, wherein the rotary drive rotates the form gear intermittently with a dwell period during which the punch forms a corrugation in the strip by deforming the strip into a cavity of the form gear.

17. The machine according to claim 16, wherein the punch includes a holder foot that engages an outgoing loop of a corrugation of the strip against the tip of the tooth of the form gear on the outgoing side of the cavity on each forming stroke of the tooth of the punch.

18. The machine according to claim 1, wherein there is a pre-form tool set and a final tool set, wherein both tool sets share a driven form gear having teeth defining cavities, wherein the pre-form tool set includes a pre-form punch having a tooth partially complementary in shape to the shape of the cavities, wherein the final tool set includes a final punch having a tooth substantially complementary in shape to the shape of the cavities, wherein the final punch is spaced-apart circumferentially from the pre-form punch, and wherein the drive includes a rotary drive rotating the driven form gear and a reciprocating linear actuator driving each punch radially of the form gear.

19. The machine according to claim 18, wherein the rotary drive rotates the form gear intermittently with a dwell period during which the punches form corrugations in the strip by deforming the strip into cavities of the form gear.

20. The machine according to claim 19, wherein each punch includes a holder foot that engages an outgoing loop of a corrugation of the strip against the tip of the tooth of the form gear on the outgoing side of the cavity on each forming stroke of the tooth of the punch.

21. A method of corrugating a metal foil strip, comprising:

providing an enclosure defining a chamber wherein the enclosure is double-walled and liquid-cooled;

maintaining the chamber at a temperature high enough to heat the foil strip so as to permit corrugations to be formed in the strip when the strip is moved through the chamber;

supplying and guiding the metal foil strip from outside the chamber into the chamber and to a tool set located in the chamber;

forming corrugations in the strip using the tool set by causing the tool set to be driven by means of a drive mounted outside the chamber and coupled to the tool set; and guiding the strip from the tool set and out of the chamber.

22. The method according to claim 21, wherein at least one gas is introduced into the chamber and heated by the heat source.

23. The method according to claim 21 and further comprising the step of supplying an inert gas to the chamber at a controlled rate.

24. The method according to claim 23, wherein the enclosure includes partition walls forming a medial sub-chamber and two end sub-chambers on opposite ends of the medial sub-chamber and an opening is provided between the medial chamber and each sub-chamber, and wherein feeder elements and delivery elements guide the strip through the sub-chambers and openings, the tool set is located in the medial sub-chamber, and the inert gas is supplied to the medial sub-chamber.

25. The method according to claim 21, wherein the step of feeding the strip includes moving the strip along a serpentine delivery path within the chamber so as to permit the strip to be heated to a temperature suitable for forming the corrugations before it reaches the tool set.

26. The method according to claim 21, wherein the step of feeding the strip includes moving the strip along and in contact with a guide chute along a path from an opening in a wall of the enclosure to the tool set.

27. The method according to claim 21, wherein the step of delivering the strip includes moving the strip along and in contact with a guide chute from the tool set to an opening in a wall of the enclosure.

28. The method according to claim 21, wherein the step of forming the corrugations includes partially forming the corrugations using a pre-form tool set and further forming the corrugations using a final tool set.

29. The method according to claim 21, wherein the corrugations are formed by a tool set that includes a driven form gear having forming teeth and an idler form gear having forming teeth meshing with the forming teeth of the driven form gear and driven by the driven form gear.

30. The method according to claim 21, wherein the corrugations are formed by a tool set that includes a driven form gear having forming teeth, an idler pre-form gear having forming teeth meshing with the forming teeth of the driven form gear at a first location along the perimeter of the driven form gear and driven by the driven form gear, and an idler final form gear having forming teeth meshing with the forming teeth of the driven form gear at a second location along the perimeter of the driven form gear spaced apart from the first location and driven by the driven form gear.

31. The method according to claim 21, wherein the corrugations are formed by a tool set that includes a driven form gear having forming teeth, an idler form gear having forming teeth meshing with the forming teeth of the driven form gear, and a gear train coupling the driven form gear and the idler form gear so that both the driven and idler form gears are driven in rotation.

32. The method according to claim 21, wherein the corrugations are formed by a pre-form tool set and a final tool set and each tool set includes a driven form gear having forming teeth, an idler form gear having forming teeth meshing with the forming teeth of the driven form gear, and a gear train coupling the driven form gear and the idler form gear so that both the driven and idler form gears are driven in rotation.

33. The method according to claim 32, wherein the driven form gear of one of the tool sets is driven by the driven form gear of the other tool set.

34. The method according to claim 21, wherein the corrugations are formed by a tool set that has a form gear having teeth defining cavities and driven in rotation and a punch having a tooth substantially complementary in shape to the shape of the cavities and driven linearly and reciprocally along an axis substantially radially of the form gear.

35. The method according to claim 34, wherein the form gear is rotated intermittently with dwell periods during which the punch at least partly forms a single corrugation in the strip by deforming the strip into a cavity of the form gear.

36. The method according to claim 33, wherein while a corrugation is being formed by the punch an outgoing loop of a corrugation of the strip is held by a foot associated with the punch against the tip of the tooth of the form gear on the outgoing side of the cavity on each forming stroke of the tooth of the punch.

37. The method according to claim 21, wherein the corrugations are formed by a pre-form tool set and a final tool set, wherein both tool sets share a rotatably driven form gear having teeth defining cavities, wherein the pre-form tool set includes a pre-form punch having a tooth partially complementary in shape to the shape of the cavities, wherein the final tool set includes a final punch having a tooth substantially complementary in shape to the shape of the cavities, wherein the final punch is spaced-apart circumferentially from the pre-form punch, and wherein each punch is driven by a reciprocating linear actuator radially of the form gear.

38. The method according to claim 37, wherein the form gear is rotated intermittently with dwell periods during which the punches form corrugations in the strip by deforming the strip into cavities of the form gear.

39. The method according to claim 38, wherein while corrugations are being formed by each punch an outgoing loop of a corrugation of the strip is held against the tip of the tooth of the form gear on the outgoing side of the cavity during each forming stroke of the tooth of the punch.

40. A machine for corrugating a metal foil strip, comprising (a) an enclosure defining a chamber;

(b) a controllable heat source for heating the chamber;

(c) at least one tool set received in the chamber and adapted to form corrugations in the metal foil strip;

(d) feeder elements supplying and guiding the metal foil strip from outside the chamber into the chamber and to the tools;

(e) a drive for the at least one tool set mounted outside the chamber and coupled to the tool set to actuate the tool set;

(f) delivery elements guiding the strip from the tools and out of the chamber; and (g) a tool set that includes a driven form gear having forming teeth, an idler pre-form gear having forming teeth meshing with the forming teeth of the driven form gear at a first location along the perimeter of the driven form gear and driven by the driven form gear, and an idler final form gear having forming teeth meshing with the forming teeth of the driven form gear at a second location along the perimeter of the driven form gear spaced apart from the first location and driven by the driven form gear.

41. A machine for corrugating a metal foil strip, comprising (a) an enclosure defining a chamber;

(b) a controllable heat source for heating the chamber;

(c) at least one tool set received in the chamber and adapted to form corrugations in the metal foil strip;

(d) feeder elements supplying and guiding the metal foil strip from outside the chamber into the chamber and to the tools;

(e) a drive for the at least one tool set mounted outside the chamber and coupled to the tool set to actuate the tool set;

(f) delivery elements guiding the strip from the tools and out of the chamber; and (g) a tool set that has a driven form gear having teeth defining cavities and a punch having a tooth substantially complementary in shape to the shape of the cavities, and the drive includes a rotary drive rotating the driven form gear and a reciprocating linear actuator driving the punch radially of the form gear.

42. The machine according to claim 41, wherein the rotary drive rotates the form gear intermittently with a dwell period during which the punch forms a corrugation in the strip by deforming the strip into a cavity of the form gear.

43. The machine according to claim 42, wherein the punch includes a holder foot that engages an outgoing loop of a corrugation of the strip against the tip of the tooth of the form gear on the outgoing side of the cavity on each forming stroke of the tooth of the punch.

44. A machine for corrugating a metal foil strip, comprising (a) an enclosure defining a chamber;

(b) a controllable heat source for heating the chamber;

(c) at least one tool set received in the chamber and adapted to form corrugations in the metal foil strip;

(d) feeder elements supplying and guiding the metal foil strip from outside the chamber into the chamber and to the tools;

(e) a drive for the at least one tool set mounted outside the chamber and coupled to the tool set to actuate the tool set;

(f) delivery elements guiding the strip from the tools and out of the chamber; and (g) a pre-form tool set and a final tool set, wherein both tool sets share a driven form gear having teeth defining cavities, wherein the pre-form tool set includes a pre-form punch having a tooth partially complementary in shape to the shape of the cavities, wherein the final tool set includes a final punch having a tooth substantially complementary in shape to the shape of the cavities, wherein the final punch is spaced-apart circumferentially from the pre-form punch, and wherein the drive includes a rotary drive rotating the driven form gear and a reciprocating linear actuator driving each punch radially of the form gear.

45. The machine according to claim 44, wherein the rotary drive rotates the form gear intermittently with a dwell period during which the punches form corrugations in the strip by deforming the strip into cavities of the form gear.

46. A machine according to claim 45, wherein each punch includes a holder foot that engages an outgoing loop of a corrugation of the strip against the tip of the tooth of the form gear on the outgoing side of the cavity on each forming stroke of the toot of the punch.

47. A method of corrugating a metal foil strip, comprising:

providing an enclosure defining a chamber;

maintaining the chamber at a temperature high enough to heat the foil strip so as to permit corrugations to be formed in the strip when the strip is moved through the chamber;

supplying and guiding the metal foil strip from outside the chamber into the chamber and to a tool set located in the chamber;

forming corrugations in the strip using the tool set by causing the tool set to be driven by means of a drive mounted outside the chamber and coupled to the tool set; and guiding the strip from the tool set and out of the chamber;

wherein the corrugations are formed by a tool set that has a form gear having teeth defining cavities and driven in rotation and a punch having a tooth substantially complementary in shape to the shape of the cavities and driven linearly and reciprocally along an axis substantially radially of the form gear.

48. The method of claim 47, wherein the form gear is rotated intermittently with dwell periods during which the punch at least partially forms a single corrugation in the strip by deforming the strip into a cavity of the form gear.

49. The method of claim 48, wherein while a corrugation is being formed by the punch an outgoing loop of a corrugation of the strip is held by a foot associated with the punch against the tip of the tooth of the form gear on the outgoing side of the cavity on each forming stroke of the tooth of the punch.

50. A method of corrugating a metal foil strip, comprising:

providing an enclosure defining a chamber;

maintaining the chamber at a temperature high enough to heat the foil strip so as to permit corrugations to be formed in the strip when the strip is moved through the chamber;

supplying and guiding the metal foil strip from outside the chamber into the chamber and to a tool set located in the chamber;

forming corrugations in the strip using the tool set by causing the tool set to be driven by means of a drive mounted outside the chamber and coupled to the tool set; and guiding the strip from the tool set and out of the chamber;

wherein the corrugations are formed by a pre-form tool set and a final tool set, wherein both tool sets share a rotatably driven form gear having teeth defining cavities, wherein the pre-form tool set includes a pre-form punch having a tooth partially complementary in shape to the shape of the cavities, wherein the final tool set includes a final punch having a tooth substantially complementary in shape to the shape of the cavities, wherein the final punch is spaced-apart circumferentially from the pre-form punch, and wherein each punch is driven by a reciprocating linear actuator radially of the form gear.

51. The method of claim 50, wherein the form gear is rotated intermittently with dwell periods during which the punches form corrugations in the strip by deforming the strip into cavities of the form gear.

52. The method of claim 51, wherein while corrugations are being formed by each punch an outgoing loop of a corrugation of the strip is held against the tip of the tooth of the form gear on the outgoing side of the cavity during each forming stroke of the tooth of the punch.

* * * * *